US005106132A

United States Patent [19]

Bako et al.

[11] Patent Number: 5,106,132

[45] Date of Patent: Apr. 21, 1992

[54] CLOSURE DEVICE FOR SUITCASES, BRIEFCASES OR THE LIKE

[75] Inventors: Laszlo Bako, Solingen; Helmut Klein, Velbert, both of Fed. Rep. of Germany

[73] Assignee: S. Franzen Söhne (GmbH & Co.), Solingen, Fed. Rep. of Germany

[21] Appl. No.: 652,515

[22] Filed: Feb. 8, 1991

[30] Foreign Application Priority Data

Oct. 20, 1990 [DE] Fed. Rep. of Germany ... 9014577[U]

[51] Int. Cl.[5] ..... A45C 13/10

[52] U.S. Cl. ..... 292/128; 292/252; 292/DIG. 72

[58] Field of Search ..... 292/252, 336.3, 121, 292/128, 219, 228, DIG. 72, DIG. 48, DIG. 65; 190/41 R

[56] References Cited

U.S. PATENT DOCUMENTS

| | | | |
|---|---|---|---|
| 2,518,256 | 8/1950 | Schall | 292/128 X |
| 3,100,980 | 8/1963 | Humphries | 292/128 X |
| 4,094,392 | 6/1978 | Gregg et al. | 190/41 R |
| 4,865,368 | 9/1989 | McCall et. al. | 292/252 X |
| 4,906,044 | 3/1990 | Wilstermann | 292/252 X |

*Primary Examiner*—Richard E. Moore
*Attorney, Agent, or Firm*—Martin A. Farber

[57] ABSTRACT

A closure device for suitcases, briefcases, or the like, has an opening-position security formed by means of a movable securing part. In order to minimize the number of parts without impairing dependable operation of the closure device, the movable securing part is developed as a rolling body (28), and is contained between surfaces (26, 27) of the push button (13) and the push button support (9) which are positioned in wedge shape with respect to each other.

10 Claims, 9 Drawing Sheets

1
3
5
16
21
42
41
41'
34
20
10
19
43
17
38'
31
33''
38
30
38''
33
32
35
33'
25
29
8
13
26
13'
K
9
27
12
23
24
28
14
22
13
15
2
14'

38'
38
38"
38
38"
37
37
11
39
40
34
10
36
35
32
35
9
12
14
14'
11
21
16
20
19
17
13
13'
31
18
27
23
15
22
33
33'
33"
28

29
25
26
14
29
24

CLOSURE DEVICE FOR SUITCASES, BRIEFCASES OR THE LIKE

FIELD AND BACKGROUND OF THE INVENTION

The present invention relates to a closure device for suitcases, briefcases and similar types of cases.

A closure device of the above type is known from U.S. Pat. No. 4,094,392. A permutation lock is centrally located on the narrow wall of the tray of the suitcase which is opposite the hinge side. On both sides of it a slide-type push button is guided in a push button support on the bottom of the suitcase. A compression spring urges the push button in the direction towards the permutation lock. At that end, there is a bar-shaped section of the push button which is provided with a bent-off portion cooperates with an angle lever which is mounted on the bottom of the suitcase around a swivel axis. If the suitcase rests on its bottom, or if it is standing vertically on its hinge-side narrow surface, the angle lever swings, as a result of gravity, into a position which makes it possible to displace the push button against spring load, releasing the cover of the suitcase. On the other hand, if the suitcase rests on its lid, the angle lever which forms the securing part is swung into such a position that the one angle arm lies in the path of the bent portion of the bar-shaped part of the push button. Then no displacement of the push button is possible and the lid cannot be opened. Opening therefore always presupposes the correct position of the suitcase.

SUMMARY OF THE INVENTION

The object of the present invention is so to develop a closure device of the type in question in a manner simple to manufacture that the parts forming the closure device are reduced to a minimum without this impairing the reliable operation of the closure device.

By virtue of the invention, there is created a closure device of the foregoing type for suitcases, briefcases or the like which is characterized by being of particularly simple construction. The number of parts necessary for establishing the closure device are reduced to a minimum without impairing the manner of operation of the closure device. The closure devices includes a securing part developed as a rolling body which, depending on the position of the suitcase, moves between surfaces of a push button and of a push button support of the closure device. These surfaces are tapered in wedge-shape towards each other, and there is obtained a particularly simple construction with respect to a securing of the open position.

Special mounting parts need not be produced. The parts which are in any event present are used to form the tapering surfaces. If, for instance, the suitcase is resting on its cover, then the rolling body moves, as a result of gravity, into the position which prevents displacement of the push button. When the suitcase is in proper resting position, on the other hand, the rolling body, which moves in the other direction, releases the push button for displacement. It should also be noted that in the blocking position of the rolling body high forces can be taken up by the closure device without damage. The closure device furthermore operates independently of additional closures of the suitcase, so that no force can be transmitted to them. The rolling body can be developed in various forms. It is possible to develop it as a cylinder or roller. A slide piece could possibly also be used. However, a rolling movement is more favorable. The rolling friction is reduced to a minimum when the rolling body is developed as a ball.

In order that the ball can come into a position of release as well as a locking position with respect to the push button, the push button support has a descending, substantially flat surface. When the ball moves away from the descending surface, this corresponds simultaneously to release of the displacement of the push button. This is the case when the suitcase is placed properly on its bottom. Sidewalls adjacent to the wedge space ensure that the ball always remains in its proper position. As a result of the fact that the push button forms a groove for surrounding a mounting arm of the push button support, a separate pin between these two parts can be dispensed with, with the aforementioned reduction of the number of parts to a minimum. Together with this, there is a corresponding saving in expense.

Furthermore, advantages in assembly result from the foregoing construction. After the placing together of the push button and the push button support, a shaftway extending substantially perpendicular to the plane of the push button is formed between the two of them. This shaftway is used to receive a spring which extends between these parts. The spring can easily be inserted after the assembling of the two parts. Its direction of action is substantially perpendicular to the plane of the swing axis, so that the push button is always swung into its starting position. One particularly suitable spring is a leaf spring bent into hairpin shape, the one arm of which rests against the push button support and the other arm of which acts on the push button. If a detent engagement for the inserted position of the spring is provided, it also serves to secure the assembled position of push button and push button support. In this connection, the one shaft wall is formed of a rear wall by a closure hook which extends from the push button. Accordingly, this closure hook performs a twofold function in that, in addition to the capturing of the mating closing part on the suitcase lid side, it is also used to form a wall of the shaft.

The closure device can, in addition, also have an ejection function. This is formed in simple manner by spacing spring elements which are arranged on both sides of the push button support and, after corresponding displacement for release of the push button, press against the end surface of the mating closure part, thus introducing an initial opening of the lid of the suitcase. Sufficient forces can be produced in the manner that the spacing spring elements consist of two compression springs which are covered by a shoe. Accordingly, the compression springs do not act directly on the end surface of the mating closure part but on the shoes. Furthermore, the shoes are also used to help in securing the compression springs in their installed position. A favorable development from the standpoint of manufacture and action results from arranging the spacing spring elements parallel to the surface of the push button. The required construction space for accommodating the spacing spring elements is therefore only very slight. Furthermore, the force supplied by the spacing spring elements is transmitted practically completely to the mating closure part, so that the opening of the lid is dependably introduced upon the swinging of the push button—the prerequisite for this being the correct resting of the suitcase.

BRIEF DESCRIPTION OF THE DRAWINGS

One embodiment of the invention will be explained in further detail below with reference to the drawings, in which.

Figure 1:
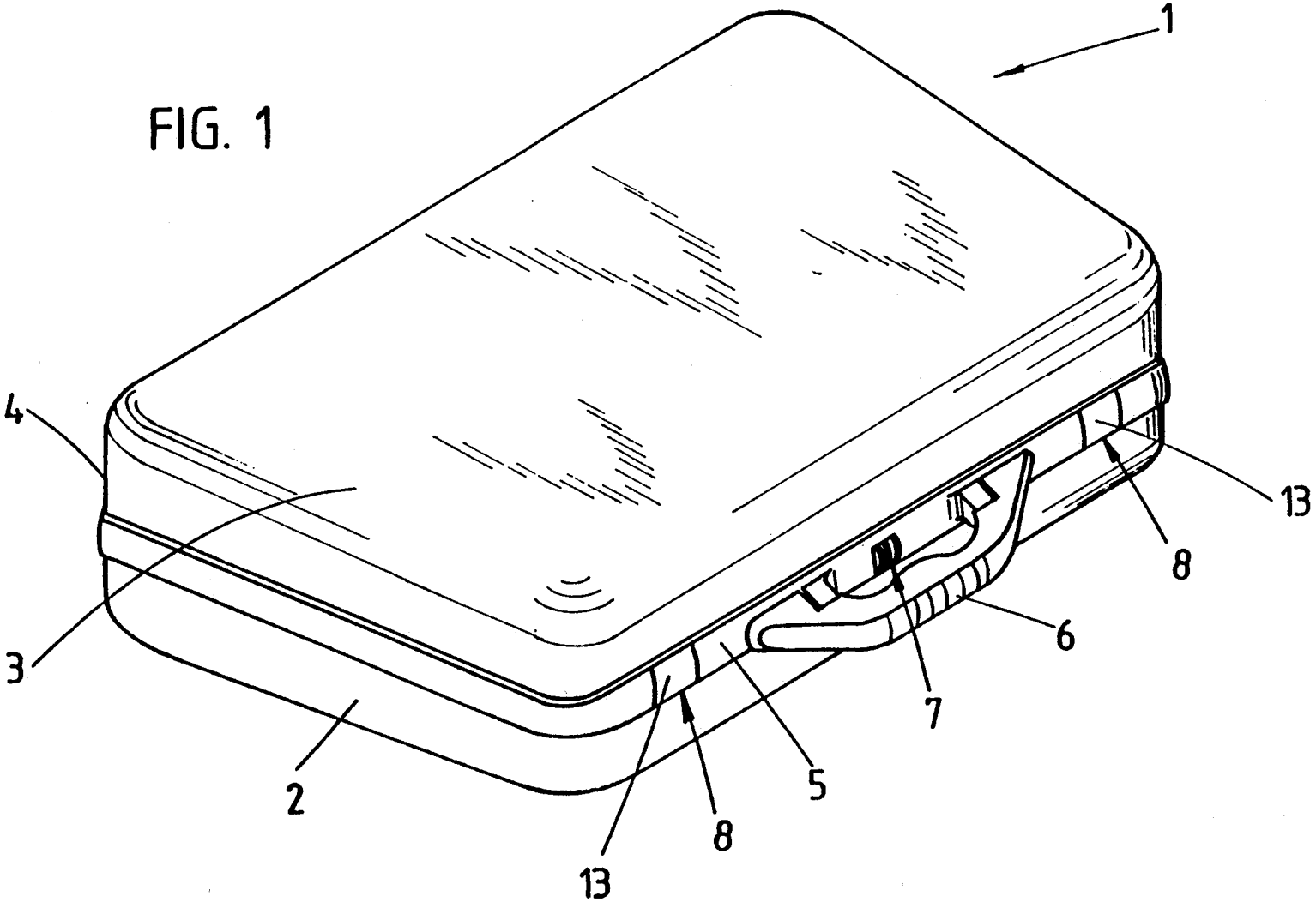
FIG. 1 is a view of a suitcase having the closure device of the invention, shown in position lying on the bottom of the suitcase.
Figure 2:
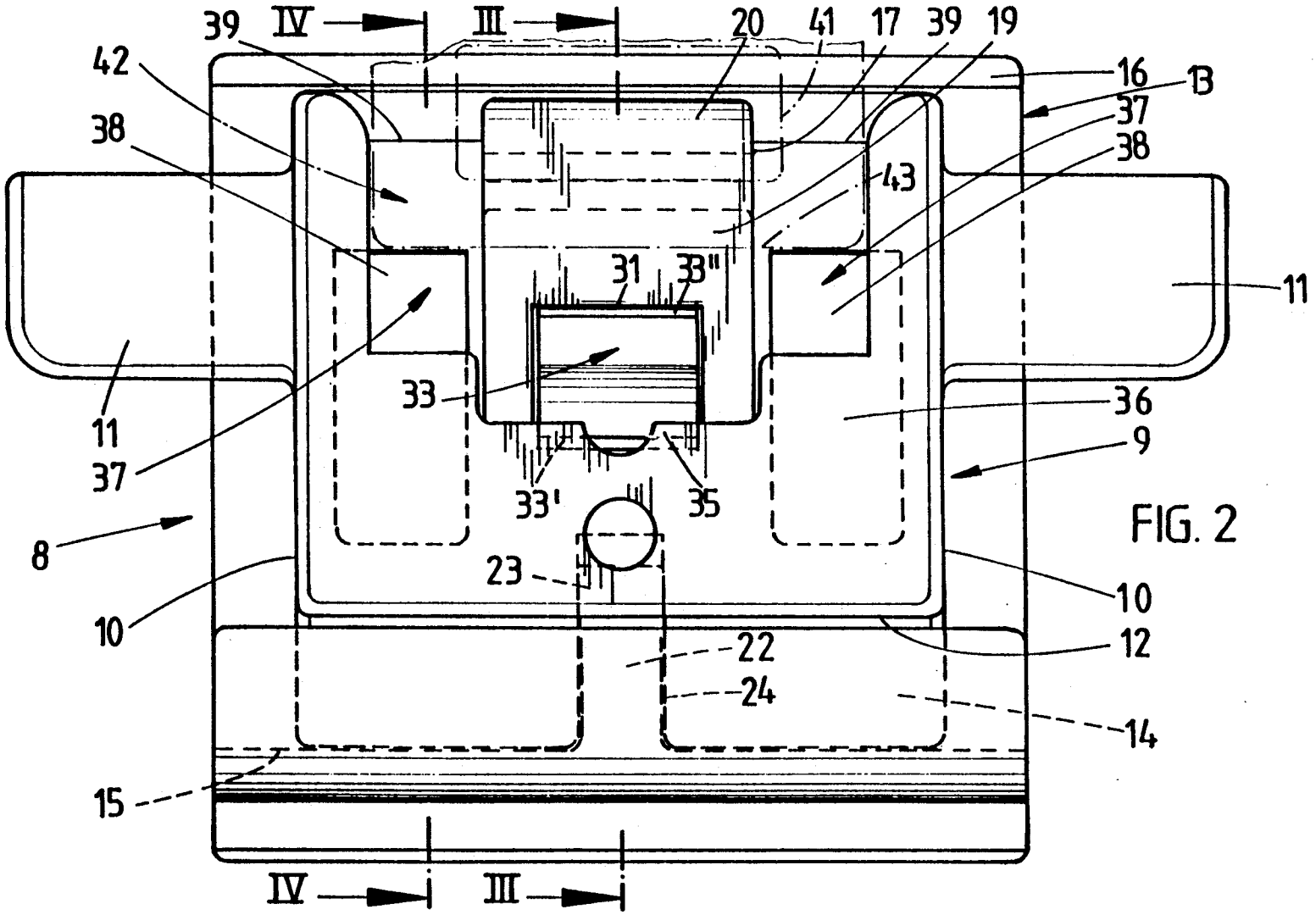
FIG. 2 is a rear view of the closure device, on a larger scale.

DETAILED DESCRIPTION OF THE PREFERRED EMBODIMENT 1 is a suitcase which has a shell-shaped suitcase bottom 2 and a suitcase lid opposite it. These two parts are swingable with respect to each other around hinges (not shown) on the one narrow longitudinal side 4 which serves as resting surface for the suitcase. The narrow longitudinal side 5 opposite the narrow longitudinal side 4 has a suitcase handle 6, a permutation lock 7 under the handle, as well as closure devices 8 arranged on both sides of the suitcase handle. The suitcase handle 6, the permutation lock 7, and the closure devices 8 are fastened on the suitcase bottom 2.

Each closure device 8 has a push button support 9 which is fastened on the suitcase bottom 2. The support is for instance box-shaped. From each of the two box sidewalls 10 which are parallel to each other there extends a wing 11 which protrudes over them and contributes to anchoring the push button support on the suitcase bottom 2. A support arm 14 extends the longitudinal box wall 12 connecting two box sidewalls 10 at the edge thereof facing a push button 13. Said arm serves to support the push button 13, which for this purpose forms a groove 15, parallel to the bottom of the suitcase, for receiving the support arm 14. Its front end 14' forms the axis of swing for the push button 13. Furthermore, a groove 15, which tapers in wedge shape, is present on the push button 13 so that the arm 14 enters with play into it, assuring swingability of the push button 13 relative to the push button support 9. The longitudinal edge of the push button 13, which is opposite the groove 15 and extends parallel to it, forms a bent-off portion 16 pointing in the direction towards the push button support 9. Between said bent-off portion and the groove 15 there is provided a closure hook 17, which extends in one piece from the rear 13' of the push button. It is of angular shape in longitudinal section, and accordingly has two angle arms 18 and 19. The angle arm 18 extends approximately perpendicular to the rear 13' of the push button 13, while the other angle arm 19 extends approximately parallel to the push button 13. On its free end the angle arm 19 forms a hook head 20 with latch bevel 21 associated with it.

Figure 6:
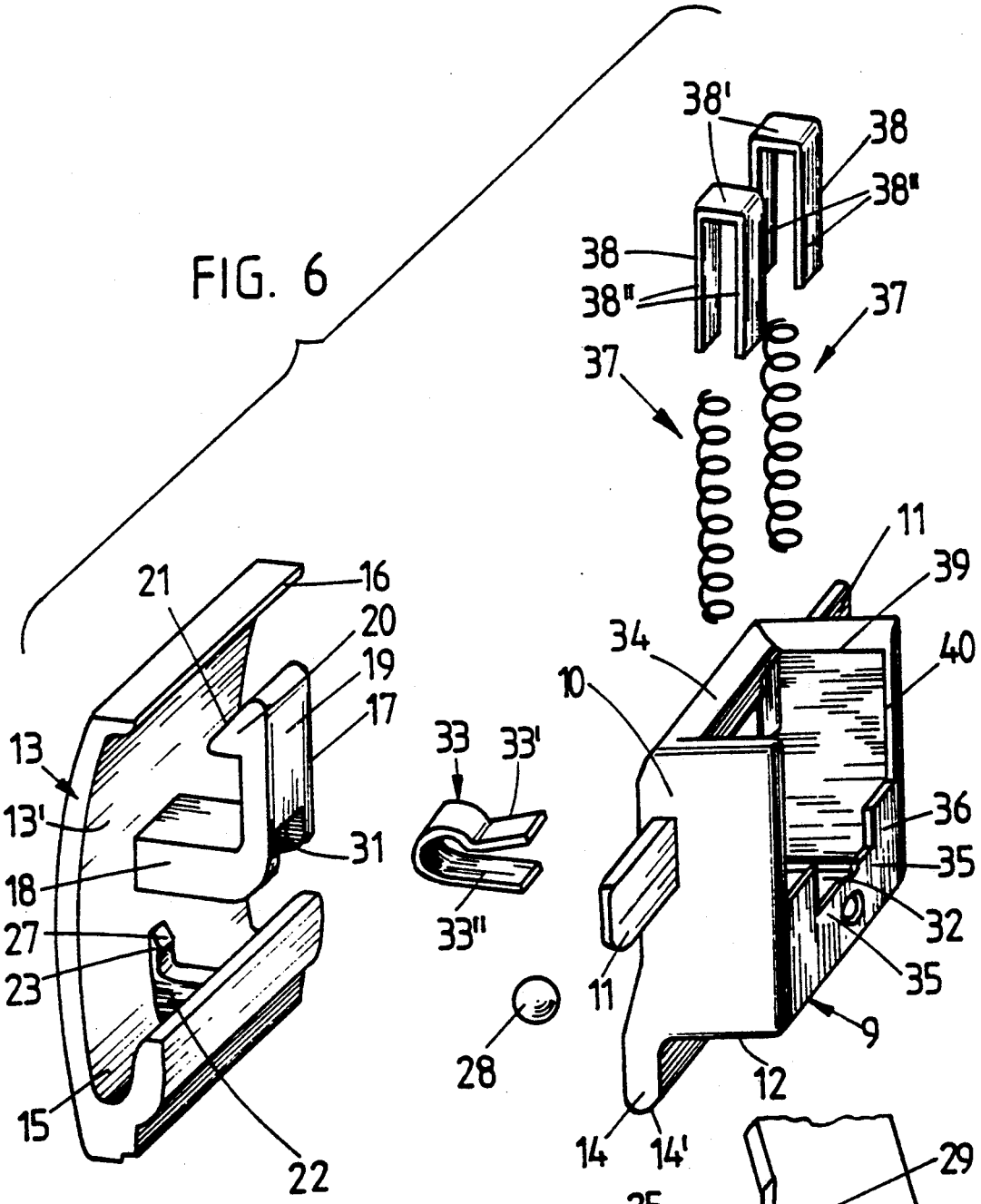
FIG. 6 is a perspective view of the individual parts of the closure device.
Figure 7:
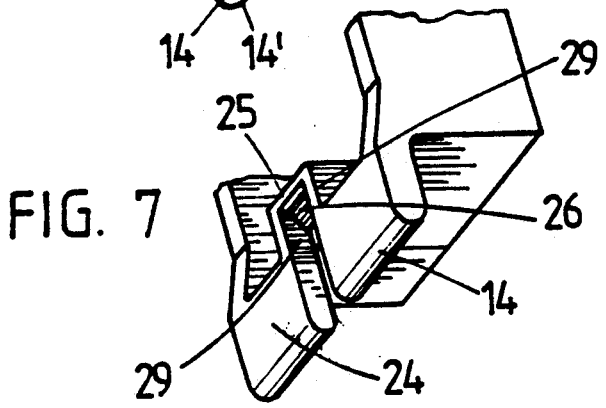
FIG. 7 is a partial rear view of the push button support seen in perspective.

Below the protruding closure hook 17 there is a transverse arm 22 which intersects the groove 15 and extends into the rear side 13' over a supporting rib 23 which points in the direction of the closure hook 17. At the same level of the transverse arm 22 the support arm 14 has a recess 24 which interrupts it and continues up into a dome 25 which extends into the inside of the push button support 9. By the recess 24 a substantially flat surface 26 descending in the direction towards the support arm 14 is formed within the dome 25. Opposite this surface there is a flat surface 27 on the push button 13. Said last-mentioned surface 27 is located at the terminal end of the support rib 23, and, together with the surface 26 of the push button support 9, forms a wedge-shaped space K which tapers down in the direction towards the support point of the push button 13. A rolling body developed as ball 28 is arranged in the wedge-shaped space K. Sidewalls 29, adjacent to the wedge-shaped space K, see to it that the ball 28 is held within the wedge-shaped space K. With the suitcase 1 lying on its bottom 2, the ball 28 rests against the upper edge of the transverse arm 22; see FIGS. 3 and 6. The diameter of the ball is so large that, in this position, the push button 13 can swing the front edge 14' of the support arm 14.

Between the push button 13 and the push button support 9 a shaftway 30, which extends substantially perpendicular to the push button plane, is formed. The one wall 31 of the shaftway is present on the angle arm 18 which extends perpendicular to the rear side 13', while the other wall 32 of the shaft is formed by the upper edge of the dome 25. The two shaft walls 31, 32 extend approximately parallel to each other; see in particular FIG. 3. The shaft 30 serves to receive a spring 33. The spring is developed as a leaf spring bent into the shape of a hairpin. The one leg 33' of this leaf spring rests against the shaft wall 22, while the other leg 33'' rests against the free end of the angle arm 18 in such a manner that the push button 13 is urged in outward direction. The swinging movement is limited by the hook head 20, which acts on the rear of the box front wall 34 of the push button support 9; see FIG. 3.

After the production of the support, the spring 33 can be inserted between push button 13 and push button support 9 from the rear thereof. In the inserted position, the leg 33' engages behind projections 35 of the box rear wall 36 of the push button support 9, securing the assembled position of the parts with respect to each other.

In the push button support 9, spacing spring elements 37 are furthermore arranged on both sides of the closure hook 17. Said elements consist of two compression springs, which are bridged over by a shoe 38 which is bent in U-shape. One end of the compression springs 37 rests against the inside of the box longitudinal wall 12. The other end of the compression springs acts on the U-arm 38' of the shoes 38. When the suitcase is not closed, the U-arms 38' abut against shoulders 39 of the box sidewalls 10. Furthermore, the box sidewalls 10 form guide edges 40 for the outward-lying U-legs 38'' of the shoes 38.

The mating closure part 42, which cooperates with the closure hook 17, is fastened on the lid 3 of the suitcase. The mating closure part has an approximately Z-shape course. At its free end, the mating closure part 42 forms a closure opening 41 for the entrance of the hook head 20 of the closure hook 17. In the closed position of the suitcase the hook head 20 extends along the lower edge 41' of the closure opening 41 and secures the closed position of the lid 3.

Figure 8:
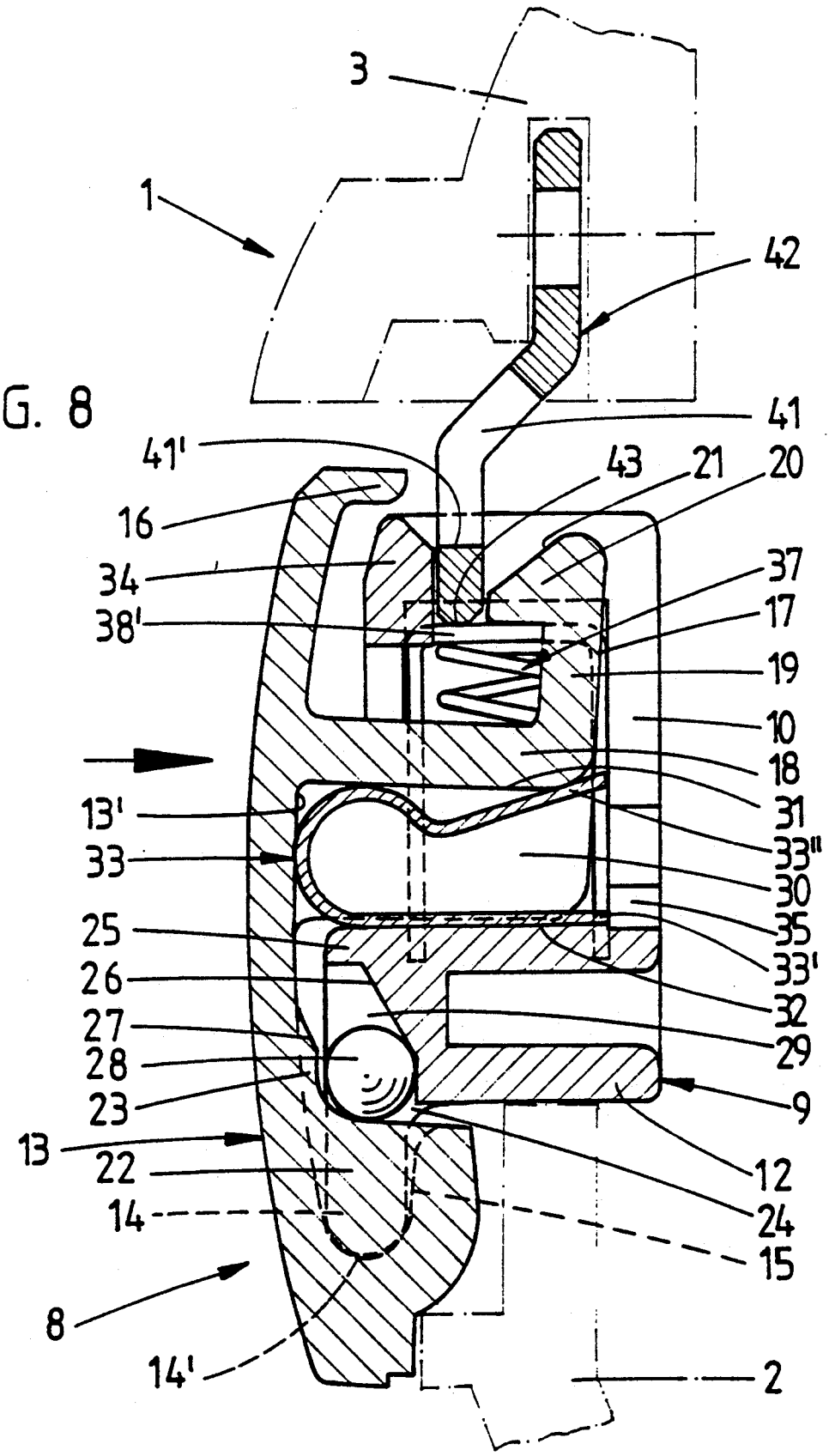
FIG. 8 is a section corresponding to FIG. 3, but with the push button displaced inwards corresponding to the suitcase resting on its bottom.

The following manner of operation is established:

If the lid 3 is closed and the suitcase placed so that it is resting on its bottom 2, then the position shown in FIGS. 1 to 5 results. The rolling body or ball 28 lies on the transverse arm 22 in such a manner that play for movement remains between the surface 26 of the push button support 9, which is located at the same height, and the stiffening rib 23 of the push button 13. Accordingly, the push button 13 can be displaced in inward direction around the axis of swing present at the front edge 14'. Hand in hand with an inward swinging of the push button 13, the hook head 20 releases the mating closure part 41; see FIG. 8. The spacing spring elements 37, which were previously cocked upon the closing of the suitcase by the front edge 43 of the mating closure part 47, can now enter into action and, by acting on the free end edge 43 of the mating closure part 47, bring about the initial opening of the lid 3 of the suitcase so that the lid can then be conveniently opened by hand.

In the open position of the suitcase, the shoes 38 rest against the shoulders 39 of the push button support 9. If the lid 3 of the suitcase is now closed, then the front edge 43 of the mating closure part 42 first of all comes against the latch bevel 21 of the hook head 20 of the closure hook 17 and brings about an inwardly directed swinging displacement of the push button 13 against the force of the spring 33. The front edge 43 comes, delayed in time, against the U-arms 38' of the shoes 38, cocking the spacing spring elements 37. If the lid 3 of the suitcase is closed sufficiently far, the hook heads 20 of the two push buttons 13 can engage into the closure openings 41 of the mating parts 42. The springs 33 then bring about a swinging of the push buttons 13 in outward direction, producing the connecting engagement between closure hooks 17 and mating closure parts 42.

Figure 9:
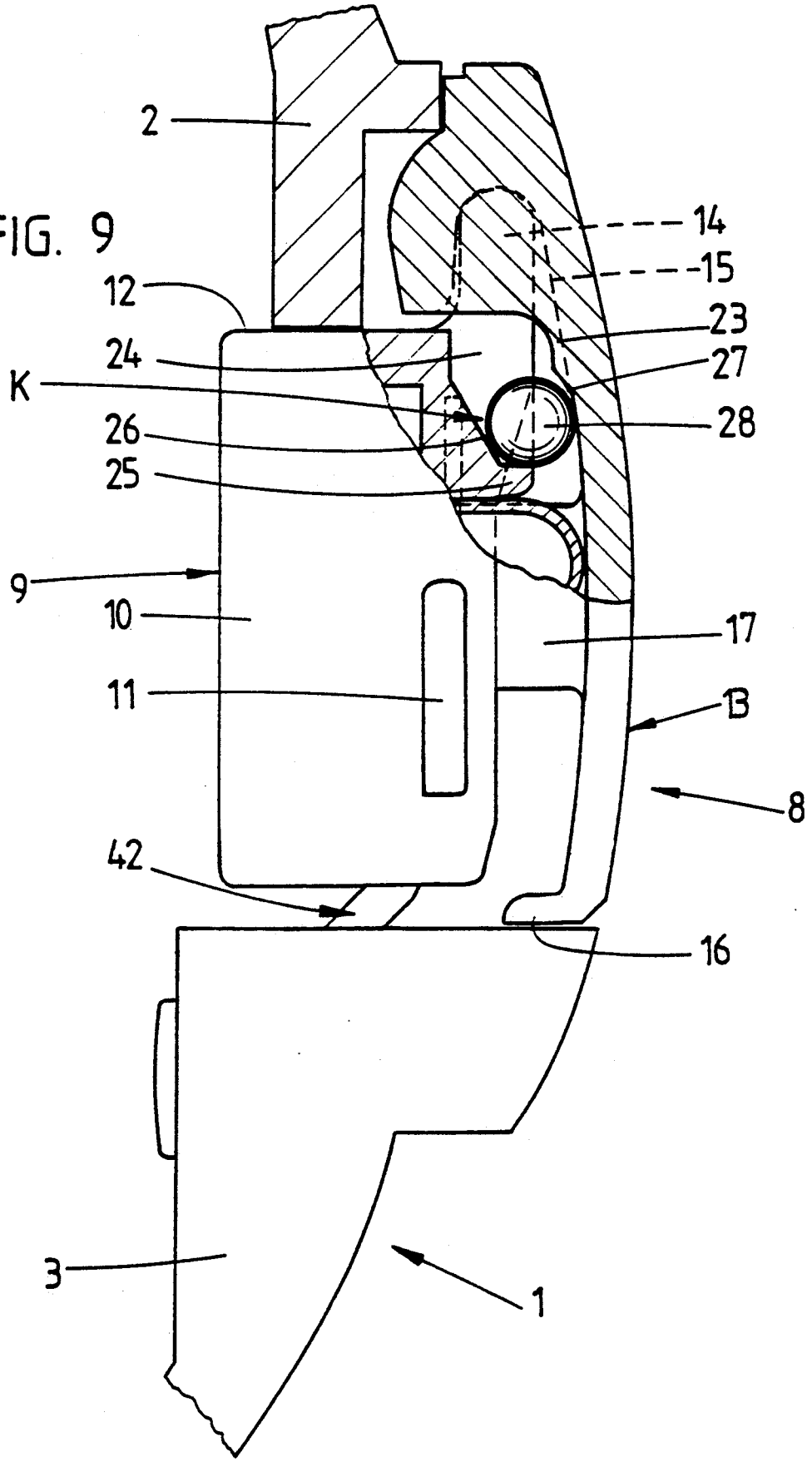
FIG. 9 is a showing which also corresponds substantially to FIG. 3, the suitcase resting on its lid with the ball in the ready-for-blocking position with respect to the surfaces of the wedge space.
Figure 10:
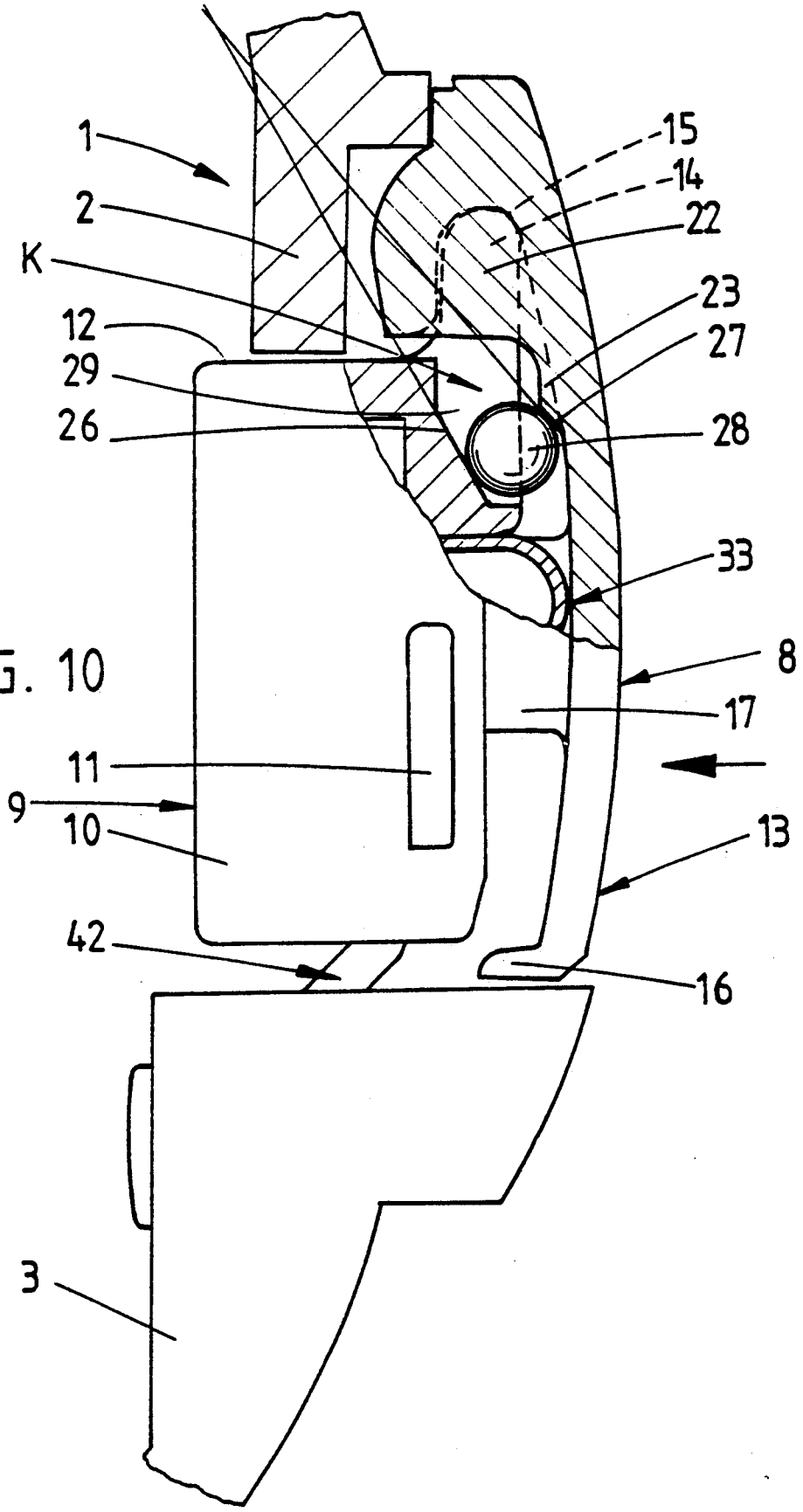
FIG. 10 shows the following position with the push button displaced a small angle of rotation, with the ball having entered into a clamping position with respect to the wedge-shaped tapered surfaces of the push button and the push button support.

It may happen that, for the opening of the suitcase, the latter is placed by mistake on its lid 3; see FIG. 9. As a result of the force of gravity, the ball 28 rolls into such a position between the two surfaces 26, 27 that after a slight swinging displacement of the push button 13 the ball is moved by it into a clamping position, which prevents further swinging of the push button 13. The mating closure part 42 is therefore not released by the closure hook 17. In this position, which is shown in FIG. 10, the lines of extending the two surfaces 26, 27 extend in such direction that they intersect approximately on the other side of the articulation point of the push button 13. The essential component of force exerted by the push button 13 acts via the ball 28 approximately perpendicularly on the surface 26 of the push button support 9. The evasion of the ball 28 in the direction towards the axis of swing of the push button 13 is also not possible as a result of the fact that the surfaces 26, 27 of push button support 9 and push button 13 extend in wedge shape to each other. The development is such that upon increased load on the push button 13 the clamping action is even increased. Therefore, even large loading forces can be taken up without damage.

Figure 3:
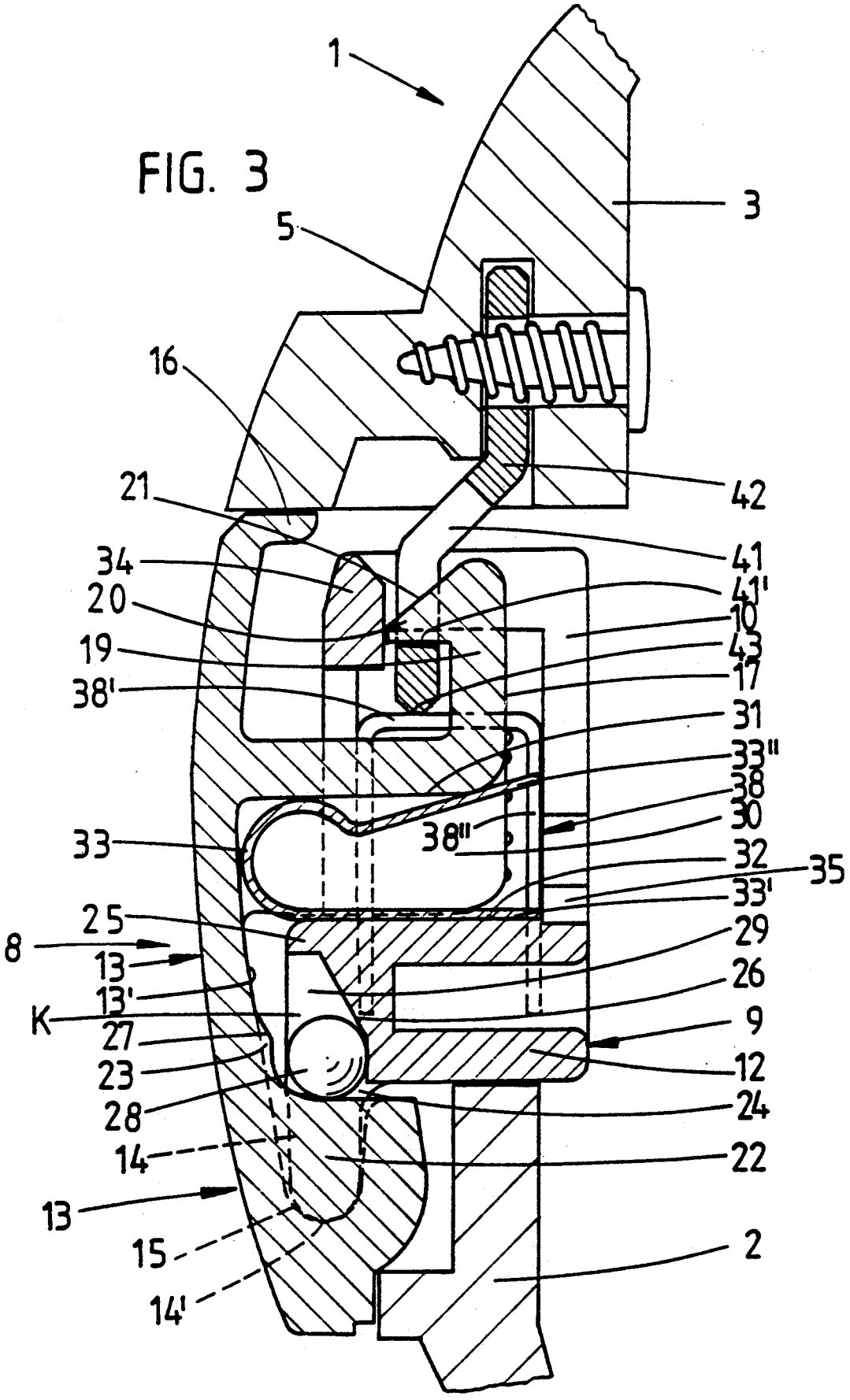
FIG. 3 is a section along the line III—III showing the closed position of the suitcase.
Figure 4:
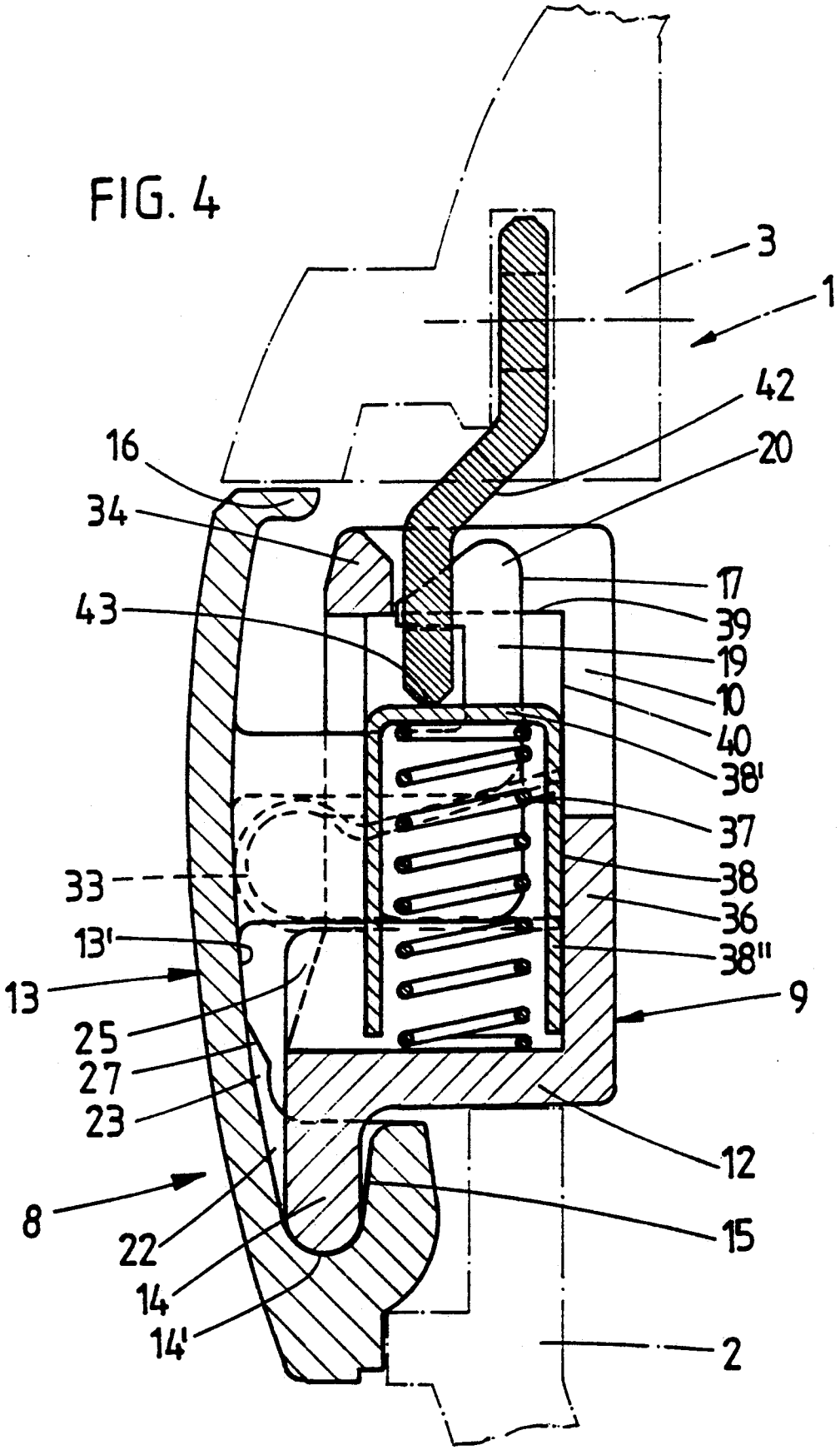
FIG. 4 is a section along the line IV—IV of FIG. 2.
Figure 5:
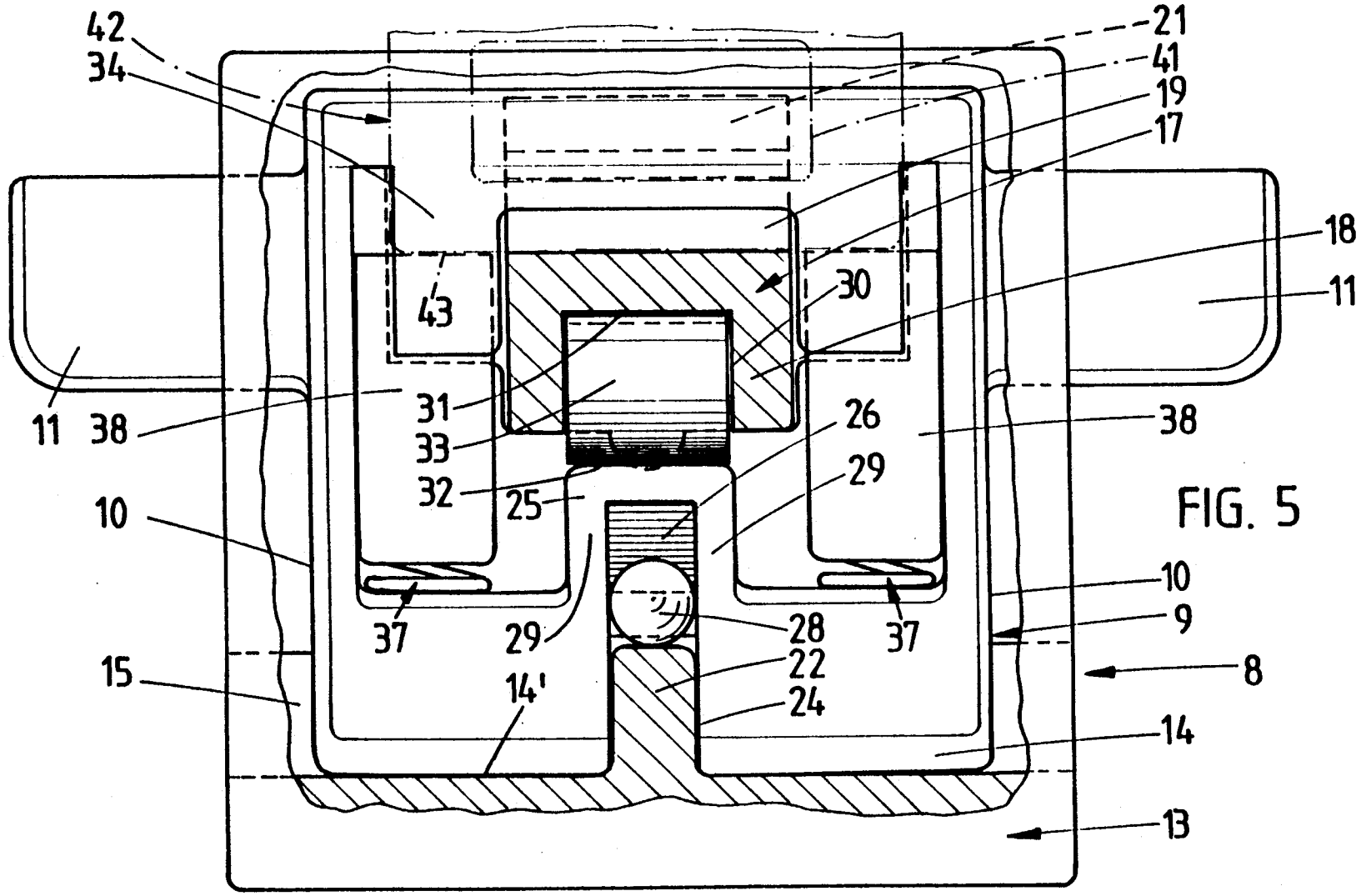
FIG. 5 is a front view of the closure device in the closed position, with the push button shown partially broken off.

If the push button 13 returns, under spring action, into its initial position, the ball 28 can pass over the surfaces 26, 27 in order, for instance, when the suitcase 1 is properly placed on its bottom 2, to assume the position of release shown in FIG. 3, which permits the displacement of the push button 13 around its axis of swing with release of the mating closure part 42.

We claim:

1. A closure device for a case including a suitcase or a briefcase, the case having a lid, the case comprising:

a push button which is a spring-urged in a closing direction of the closure device;

a push button support, and an opening position safety formed by a movable securing part;

a closure hook extending from the push button;

a first spacing spring element and a second spacing spring element located in the push button support and arranged on opposite sides of the closure hook to establish an incipient opening of the lid of the case;

wherein the movable securing part comprises a rolling body which is caught between surfaces of the push button and the push button support, said surfaces tapering in wedge shape relative to each other; and the spacing spring elements move within a contour of the push button support.

2. A closure device for a case including a suitcase or a briefcase, the case having a lid, the case comprising:

a push button which is spring-urged in a closing direction of the closure device;

a push button support, and an opening position safety formed by a movable securing part;

a closure hook extending from the push button;

a first spacing spring element and a second spacing spring element located in the push button support and arranged on opposite sides of the closure hook to establish an incipient opening of the lid of the case;

wherein the movable securing part comprises a rolling body which is caught between surfaces of the push button and the push button support, said surfaces tapering in wedge shape relative to each other; and the closure device further comprises a first shoe and a second shoe, said first and said second spacing spring elements comprising respectively a first and a second compression spring, said first and said second compression springs being bridged over, respectively, by said first and said second shoe.

3. A closure device for a case including a suitcase or a briefcase, the case having a lid, the case comprising:

a push button which is spring-urged in a closing direction of the closure device;

a push button support, and an opening position safety formed by a movable securing part, the push button being movable relative to the push button support;

a closure hook extending from the push button;

wherein the movable securing part comprises a rolling ball which is caught between surfaces of the push button and the push button support, said surfaces tapering in wedge shape relative to each other to form space for containing the ball;

the push button support includes a supporting web having a front edge which serves as a swing axis about which the push button pivots;

the push button includes a groove, and a transverse web which extends from a surface of the push button facing the push button support support, the transverse web transecting the groove, the groove receiving the front edge of the supporting web;

the supporting web includes a cutout which mates with the transverse web;

the push button support includes a front box wall located opposite the supporting web of the push button support; and the closure hook has a hook head which lies opposite the swing axis of the push button, and engages with the box front wall of the push button support.

4. A closure device according to claim 3, wherein said push button support has a substantially flat surface which provides a wedge shape to said ball containing space.

5. A closure device according to claim 4, wherein said push button support comprises sidewalls located adjacent to said ball-containing space.

6. A closure device according to claim 3, wherein said push button and said push button support extend parallel to a plane, said closure device comprising a shaftway disposed between said push button and said push button support and extending substantially perpendicular to said plane; and a spring received by said shaftway and which extends between said push button and said push button support to act substantially in a plane perpendicular to said axis of swing.

7. A closure device according to claim 6, wherein said closure hook serves as a shaft wall of said shaftway.

8. A closure device according to claim 3, further comprising a plurality of spacing spring elements arranged in said push button support on opposite sides of said closure hook to effect an incipient opening of the lid of said case.

9. A closure device according to claim 8, further comprising closure parts extending from said push button support and mating with said spacing spring elements; and wherein said spacing spring elements act upon the opening of said case against said closure parts.

10. A closure device according to claim 9, wherein said push button and said push button support are disposed along a plane; and said spacing spring elements are approximately parallel to said plane.

* * * * *